US005678735A

United States Patent [19]

Guglielmini

[11] Patent Number: 5,678,735

[45] Date of Patent: Oct. 21, 1997

[54] RUPTURABLE STOPPER FOR A POURING SPOUT

[75] Inventor: Bernard Guglielmini, Criodlois, France

[73] Assignee: Rical, France

[21] Appl. No.: 449,270

[22] Filed: May 24, 1995

[30] Foreign Application Priority Data

May 24, 1994 [FR] France ..... 94 06501

[51] Int. Cl.[6] ..... B67B 5/00

[52] U.S. Cl. ..... 222/153.06; 222/527; 222/570; 220/276; 220/288; 215/253

[58] Field of Search ..... 222/105, 153.06, 222/546, 570, 527; 220/276, 288; 215/204, 253

[56] References Cited

U.S. PATENT DOCUMENTS

| | | | |
|---|---|---|---|
| 3,923,185 | 12/1975 | Choksi et al. | 215/253 |
| 4,729,488 | 3/1988 | Bullock, III | 220/276 X |
| 5,228,593 | 7/1993 | O'Meara | 222/153.06 X |

FOREIGN PATENT DOCUMENTS

| | | |
|---|---|---|
| 1 417 219 | 10/1965 | France . |
| 1 417 219 | 5/1966 | France . |
| 41 39 896 A1 | 6/1993 | Germany . |
| 884691 | 12/1961 | United Kingdom . |
| 2 200 898 | 8/1988 | United Kingdom . |

*Primary Examiner*—Gregory L. Huson
*Attorney, Agent, or Firm*—Bacon & Thomas

[57] ABSTRACT

A rupturable stopper for a pouring spout for a receptacle includes a base having a pouring zone sealed closed by a cover connected to the base by frangible connection. The spout includes a tubular neck having internal screw threads connected to the base so as to surround the frangible connection and terminating at a pouring lip. A cylindrical appendage extending up from the cover lies concentrically within the neck and receives a closure cap thereon that includes screw threads engageable with the neck and a seal that engages a spout pouring lip when the cap is engaged with the spout neck. Interlocking elements between the cap and the appendage prevent reverse rotation of the cap relative to the appendage so that, once the cap is secured in place within the neck by the screw threads, the first attempt to remove the cap drives the appendage in a twisting and axial movement to cause rupture of the frangible connection to open the pouring zone of the base. Reapplication of the cap in the neck reseals the pouring zone with the original cover and also seals the spout along the lip area of the neck.

10 Claims, 2 Drawing Sheets

RUPTURABLE STOPPER FOR A POURING SPOUT

FIELD OF THE INVENTION

The invention relates to a rupturable stopper for a pouring spout (pouring stopper) for receptacles intended to contain and dispense flowable materials.

BACKGROUND OF THE INVENTION

Discussion of Related Art

Prior-art pouring stoppers are composed of a neck, opening outwardly or not, on which may be mounted or removed a cap for closure. For the function of pouring, such stoppers may be considered as particularly well adapted, insofar as the technique does not appear to be the subject of developments or novel propositions.

Such pouring stoppers must also necessarily respond to another obligation, that of being able to ensure, in a tight and impregnable manner, the closure of the receptacle, so as to guarantee to the user, when he/she first uses it, that no fraudulent attempt, successful or not, has been made to open the stopper or to tamper with it.

Strictly speaking, such a function is not performed by the pouring stopper, but by some added means which must be destroyed by any appropriate means.

In the case of application of pouring stoppers removably fitted on receptacles, generally for single use, such a method has proved unsatisfactory, this leading to other propositions consisting in providing the pouring stopper with a sealing membrane covering the section of passage (pouring zone) in order to guarantee impregnability of the contents.

Known propositions employ a membrane which is characterized by the need to develop a relatively high tearing effort, creating discomfort and even, in certain cases, the impossibility to open manually without resorting to a special or makeshift tool.

The function of tearing or of opening is generally such that, when the tear is made and the internal medium in the package is brought into contact with the outside medium, it also causes more or less considerable projection of the internal medium which generally has a polluting effect.

Such drawbacks are still more penalizing when the pouring stopper presents a small diameter of opening, making it even more delicate and even problematic to have access to the membrane, either directly or via a gripping element associated therewith.

In an attempt to overcome the drawbacks set forth hereinabove, the solution of making the impregnable membrane or cover with a small thickness so that the tearing effort remains modest has been contemplated. In order to obtain such an effect, however, it is necessary to make the membrane with a thickness of some hundredths of a millimeter which, as a function of the materials use, runs the risk of micro-perforations occurring which would be detrimental to the hermetic nature of the packaging to be produced. Such a risk must be considered in particular when the pouring stopper is made of moulded plastics materials such as, for example, low-density polyethylene.

BRIEF SUMMARY OF THE INVENTION

It is an object of the present invention to provide a novel pouring stopper whose general structure may be qualified as an improvement of prior art stoppers, but which is provided with a particular means for performing the function of impregnability upon first use, requiring of the user only a slight physical effort to tear a cover which, in addition, guarantees an opening without risk of projecting the contents of the receptacle. Another object of the invention is to produce a pouring stopper entirely of moulded plastics material, based on two component elements which may be automatically mounted and assembled, in order to constitute an assembly which gives the user an indubitable guarantee of impregnability, when he/she uses it.

A further object of the invention is to produce a pouring stopper of plastics material, of which the means for covering the section of passage of the pouring stopper can perform a function of tight closure, bereft of any micro-holes or micro-perforations, without the tearing or opening thereof requiring of the user a considerable physical effort with risks of contents projection.

A further object of the invention is to offer the user, after first use, the possibility of efficient tight reclosure, preventing any exchange between the internal contents and the outside medium.

In order to attain the objects set forth hereinabove, the pouring stopper according to the invention comprises a rupturable stopper for a pouring spout for a receptacle that includes a base having a pouring zone closed by a cover connected to the base by a frangible connection. The spout includes a tubular neck having internal screw threads connected to the base so as to surround the frangible connection and terminating at a pouring lip. A cylindrical appendage extending up from the cover lies concentrically within the neck and receives a closure cap thereon that includes screw threads engageable with the neck and a seal that engages a spout pouring lip when the cap is engaged with the spout neck. Interlocking elements between the cap and the appendage prevent reverse rotation of the cap relative to the appendage so that, once the cap is secured in place within the neck by the screw threads, the first attempt to remove the cap drives the appendage in a twisting and axial movement to cause rupture of the frangible connection to open the pouring zone of the base. Reapplication of the cap in the neck reseals the pouring zone with the original cover and also seals the spout along the lip area of the neck.

BRIEF DESCRIPTION OF THE DRAWINGS

The invention will be more readily understood on reading the following description with reference to the accompanying drawings, in which.

DESCRIPTION OF PREFERRED EMBODIMENTS

Figure 1:
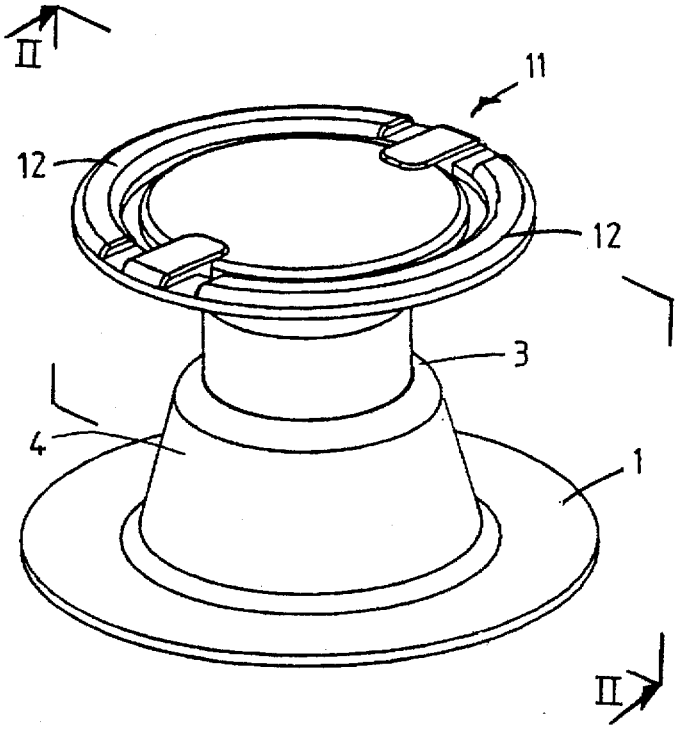
FIG. 1 is a perspective view of the pouring stopper according to the invention in the closed state.
Figure 2:
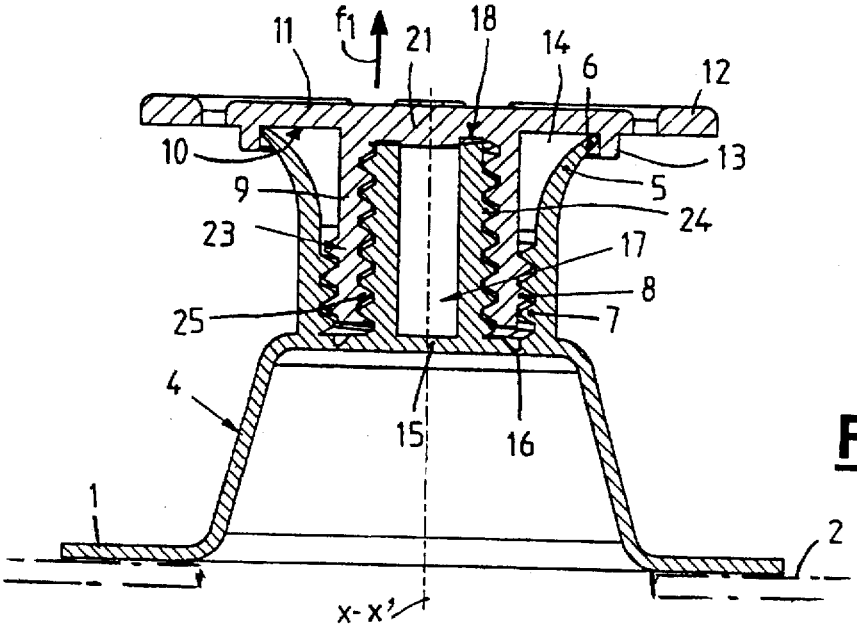
FIG. 2 is a diametrical cross section taken along plane II—II of FIG. 1.

Referring now to the drawings, FIGS. 1 and 2 show a rupturable stopper for a pouring spout or pouring stopper according to the invention, shown as an independent element capable of being added via a connection structure 1 on a receptacle 2 of any appropriate material.

The connection between the base 1 and the receptacle 2 does not form a direct part of the invention, and is known prior art. In the same spirit, it must also be considered that the object of the invention may be employed on a pouring spout whose connection structure 1 is integral with the receptacle.

In the preferred example, as illustrated in FIGS. 1 and 2, the connection structure 1 is constituted by a flange and is joined to a cylindrical tubular neck 2 having a central axis x–x' via a gusset 4 deformable to an extent that it enables the neck 2 to be placed either in a position inserted inside the recipient 2 or, after traction, in a position of outward extension, as illustrated in FIG. 2, which corresponds to a state of use.

The pouring stopper is preferable made of an appropriate plastics material such as low-density polyethylene.

The tubular cylindrical neck 3 includes an upper or distal part 2 of outwardly flared form, forming an annular pouring lip terminating in a lip 6 of slightly deformable nature. The cylindrical neck 3 further includes on its inner peripheral wall, at least one helicoidal screw thread 7 adapted to cooperate with complementary screw threads 8 located on the outer peripheral wall of a tubular connecting portion 9 extending axially from the lower radial face 10 of a cap 11 for closing the pouring lip. The cap 11 comprises, on its periphery or organised in substantially an equivalent manner, a gripping and traction ring 12 occupying in the state of rest a stable position in the radially extending plane of the cap 11, as illustrated in FIGS. 1 and 2. The cap 11 furthermore includes, extending axially from its lower face 1-, an annular flange 13 defining a housing 14 inside of which fits the lip 6 to perform a function of closure in the position of assembly of the cap 11 on the neck 3.

According to the invention, the neck 3 is at its proximal end is closed substantially in the plane of its intersection with the gusset 4, by a cover 15 moulded therewith and presenting a frangible zone or connection 16 of least resistance which may be made in any suitable manner. The zone 16 may correspond to a peripheral furrow whose diameter is for example close to or slightly less than the inner diameter of the helicoidal thread 7. The cover 15 is surmounted by a cylindrical appendage 17 rising coaxially substantially over the whole height of the neck 3 and the upper part 5, being centered on axis x–x'. Preferably but not necessarily, the appendage 17 is in tubular form, presenting an outer diameter selected to allow it to engage inside the bore of tubular connecting portion 9.

Upon assembly of the cap 11, the above embodiment enables the connecting portion 9 to fit over the appendage 17, as is illustrated in FIG. 2.

Figure 3:
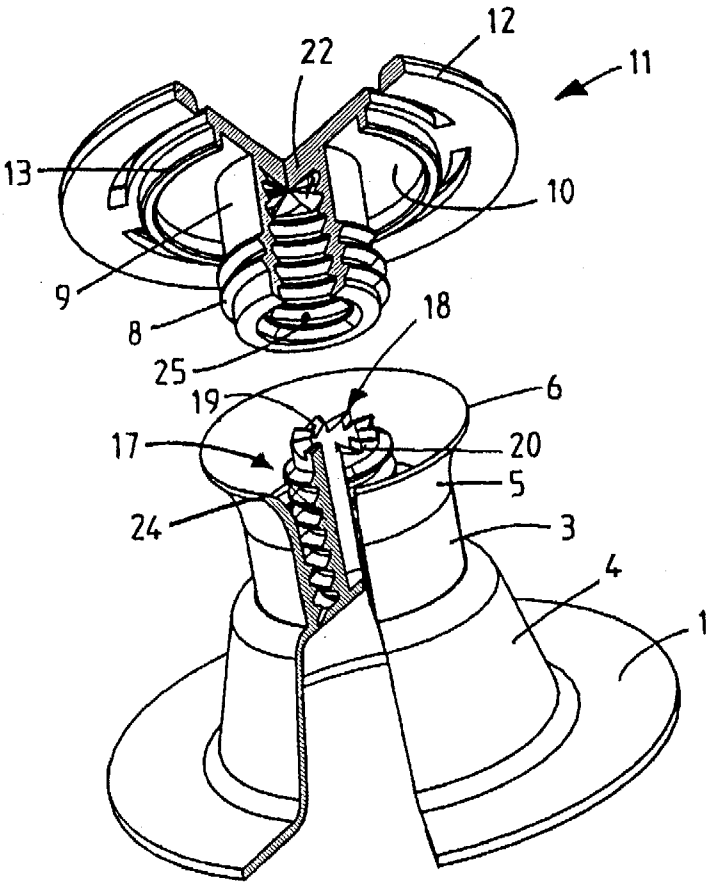
FIG. 3 is an exploded view in perspective, partly in section, showing certain constructional characteristics of one embodiment of the invention.

According to the invention, between the appendage 17 and the connecting portion 9 is provided, a means capable of joining them angularly (antirotationally) in the sense of unscrewing after a first assembly of the cap 11 on the neck 3, by the cooperation of threads 7 and 8. The angular antirotation connection means, designated as a whole by reference 18, is constituted, in a first embodiment according to FIGS. 2 and 3, by notches 18 in the form of asymmetrical teeth, projecting on the upper distal part of the appendage 17 and more particularly on the transverse end thereof. Each notch 18 comprises a ramp 19 inclined upwardly in the direction or sense of normal screwing together of cap and neck and joined to an abrupt face 20 which terminates at the ramp 19 of the consecutive notch.

The angular connection means further comprises, on the inner proximal bottom end of the bore of tubular connecting portion 9, complementary notches 22 presenting a shape corresponding to that of notches 18. In this way, when the cap 11 is first positioned, the screwing together of the connecting portion 9 by means 7 and 8 results in the notches 18 and 22 cooperating, up to the position of maximum axial engagement at which the notches 18 and 22 are in mutual engagement, for opposing any possibility of unscrewing of the cap 11.

The angular connection means as described hereinabove may be made substantially differently, by employing notches technically equivalent for the function having to be performed, but formed relatively on the outer periphery of the appendage 17 and respectively on the inner periphery of the connecting portion 9, either in the vicinity of the transverse end of appendage 17 and the bore bottom 21, or in the vicinity of the cover 15.

According to the invention, it is provided likewise to employ secondary locking means 23 for axially securing the appendage 17 and the connecting portion 9. In an advantageous embodiment, the means 23 comprise at least one helicoidal thread 24 formed by the outer periphery of the appendage 17 and at least one helicoidal thread 25 presented by the inner peripheral wall of the bore of connecting portion 9. The threads 24 and 25 are formed so as to allow screwing therebetween simultaneously with the threads 7 and 8 described hereinbefore.

Threads 24 and 25 are furthermore made so as to respect the preceding condition which is that of ensuring cooperation and interference or fit of the notches 18 and 22 during thorough screwing of threads of the cap 11, via the connecting portion 9, both by engagement on the appendage 17 and by cooperation with the thread 7 of the neck 3.

Thus, in this position, as illustrated in FIG. 2, the cap 11 is mounted firmly and tightly on the neck 3 which is further more sealed via the cover 15. This state corresponds to a first closure of the receptacle 2 after filling with its contents.

When the user wishes to open the receptacle 2 for the first time, he acts firstly on the ring or rings 12 to place the gusset 4 in the position of FIG. 2, from a retracted position which has not been shown, but is well known.

In this state, the user may then act on the cap 11 in the conventional sense of unscrewing, to extract the connecting portion 9. Such an unscrewing action which is allowed by the cooperation of the threads 7 and 8, is, on the other hand, hindered by the interference of notches 18 and 22.

The unscrewing action imposed by the user is therefore translated by a tendency to drive the appendage 17 in rotation in the same direction, which, as a consequence, results in a break of the fracture zone of least resistance 16.

Simultaneously, the action of screwing made on the cap 11 causes threads 7 and 8 to cooperate, which generate an axial displacement of the connecting portion 9 in the direction of arrow $f_1$. By reason of the hindered relative rotation between the connecting portion 9 and the appendage 17, the displacement of the connecting portion 9, even though slight, in the direction of arrow $f_1$ contributes, in combination with the preceding action, to provoking rupture of the cover 15 along the frangible zone of least resistance 16.

In this way and without the user having to conduct any other action, the first attempt to unscrew and open the pouring stopper according to the invention produces rupture of the cover 15 which remains associated with the appendage 17, which itself is joined by means 23 to the connecting portion 9.

When opening for the first time, the user is informed on the nature of impregnability due to the tactile perception that he or she necessarily feels by the need to make an effort of rotation greater than normal to provoke, by the two actions hereinabove, rupture of the zone 16.

Figure 4:
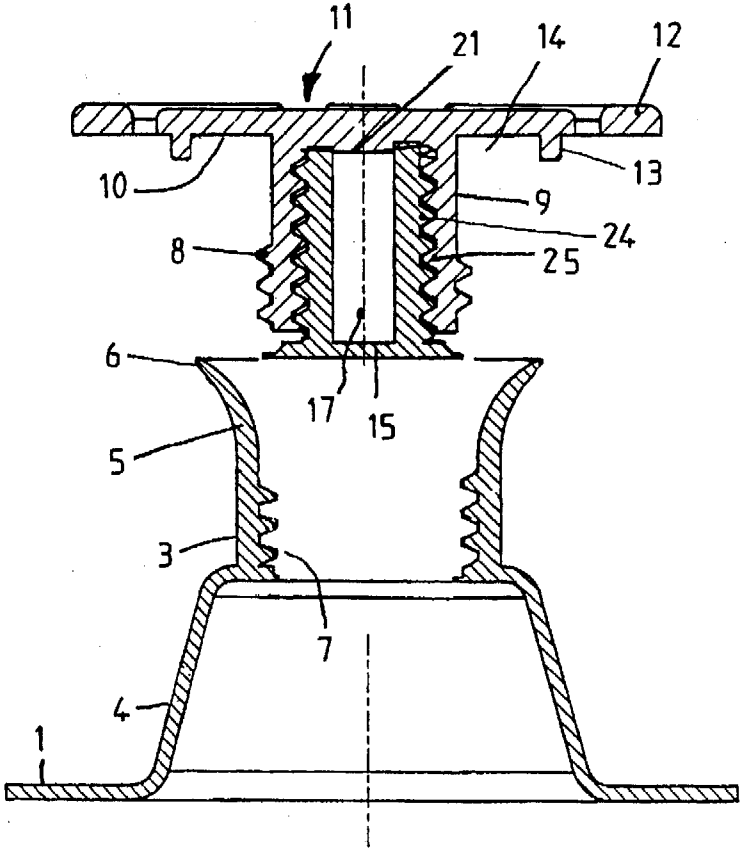
FIG. 4 is a partial sectional-elevation illustrating the pouring stopper according to the invention in the state consecutive to first opening.

The cap 11 may then be unscrewed in order to open the neck 3 completely, as illustrated in FIG. 4 and to allow partial emptying of the receptacle 2.

Upon subsequent closure, the connecting portion 9 is screwed to neck 3 by cooperation of thread 8 with thread 7 until the lip 6 is brought inside the housing 14 in cooperation with the flange 13 and the inner face 10, to ensure tight closure of the neck 3 inside which the cover 15 has been replaced.

The means according to the invention make it possible to produce, in one moulding operation in the same material, on the one hand,cap 11 which may be the other hand, the cap 11 which may be mounted, as stated previously, to ensure tight closure with guarantee of impregnability felt by the user upon first opening.

The additional effort of unscrewing necessitated to fracture the zone 16 does not involve a considerable physical effort for the user, given that it is developed from a cap 11 of large diameter, the rotation of which is transformed by means 18 and means 23 into a double action of deformation rotating in the plane of the cover 15 and of axial displacement of appendage 17 and cover 15 which, in combination, provoke tear of the zone 16 which may be made with a thickness such that it guarantees in all cases the existence of a tight barrier between the ambient medium and the inner volume of the receptacle.

Figure 5:
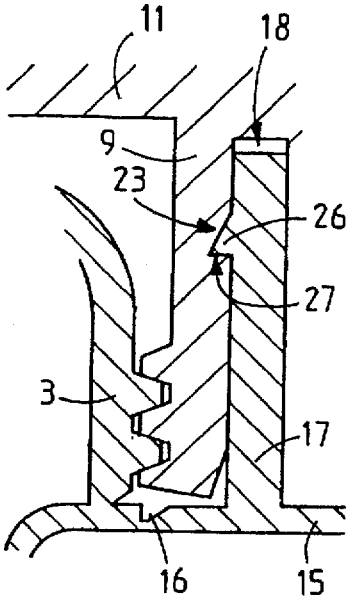
FIG. 5 is a partial section-elevation showing another embodiment of the invention.

FIG. 5 shows an alternate embodiment in which the means 23 for axially connecting the appendage 17 and the connecting portion 9 are constituted by at least one continuous or discontinuous rib 26 of asymmetrical cross section, projecting for example by the outer peripheral face of the appendage 17, to cooperate with a complementary shape or groove 27 presented for example by the inner peripheral face of the bore of connecting portion 9.

The cross sectional shape of the rib 26 and of groove 27 is chosen so that, after relative fit during first assembly of the cap 11 on the neck 3, an axial connection is established to oppose the relative displacement in the direction of arrow $f_1$, of connection portion 9 with respect to appendage 17.

Although this has not been shown, it must be considered that the continuous or discontinuous rib 26 may equally well project from the inner peripheral wall of the bore connecting portion 9.

The relative location of the rib 26 and of the groove 27 may be chosen in different manners over the whole useful height of the appendage 17, as a function of the manufacturing conditions contemplated.

The invention is not limited to the examples described and shown, as various modifications may be made thereto without departing from the scope of the invention.

What is claimed is:

1. A rupturable stopper for a pouring spout comprising a base having a pouring zone sealed closed by a cover connected to the base by a frangible connection;

a tubular neck having an end connected to the base so as to surround the frangible connection and terminating at its other end at a pouring lip, said neck and lip constituting a pouring spout, and said neck including internal screw threads;

a cylindrical appendage connected to and extending coaxially within the tube towards the pouring lip;

a closure cap including a tubular connecting portion having external screw-threads and a cylindrical bore;

said screw cap secured to said neck by threading the screw threads of the connecting portion into the screw threads of the neck with said bore concentrically overlying said appendage;

said cap including a seal portion engageable with said pouring lip when said connecting portion is threadedly secured to said neck;

said cap and said appendage including cooperating locking elements that are engageable upon engagement of the connecting portion external threads to the neck internal threads by relative rotational movement in a screw thread advancing direction, said locking elements being configured to prevent reverse relative rotation between the cap and appendage in a screw unthreading direction.

2. A rupturable stopper according to claim 1, including a secondary cooperating locking means for securing the appendage and connecting portion of the cap against relative axial motion in a separation direction, said secondary locking means including means for causing its activation only after the neck internal threads and connecting portion external threads are threadedly secured together.

3. A rupturable stopper as claimed in claim 1 or 2, wherein said locking elements comprise asymmetrical teeth and notches that slide over each other in one direction of relative motion and interfere with each other in a reverse direction of relative motion.

4. A rupturable stopper according to claim 3, wherein said locking elements are disposed at the distal end of the appendage and the inner proximal end of the cylindrical bore of the cap connecting portion.

5. A rupturable stopper according to claim 3, wherein said locking elements are disposed on the outer wall of the appendage and the inner wall of the bore of the cap connecting portion.

6. A rupturable stopper according to claim 2, wherein said secondary locking elements comprise complementary screw threads on the outer surface of the appendage and the inner surface of the bore of the connecting portion of the cap.

7. A rupturable stopper according to claim 2, wherein said secondary locking elements comprise a peripheral rib disposed on one of the appendages and inner bore of the connecting portion of the cap, and a mating notch located on the other one of the appendage and inner bore of the connecting portion of the cap, said rib and notch configured to slide past each other in one direction of relative axial motion and interfere with each other in an opposite direction of relative axial motion.

8. A rupturable stopper according to claim 1, said cap including an axial flange portion extending parallel to and coaxially spaced from said connecting portion, said flange portion dimensioned to fit over and around said pouring lip when said cap is engaged with said neck.

9. A rupturable stopper according to claim 8, wherein said cap includes an inner face extending radially of said connecting portion, and wherein said pouring lip is deformable and is flared outwardly, and said inner face and flange engage said pouring lip in sealing relationship when said cap and neck are secured by said screw threads.

10. A rupturable stopper according to claim 1, including a connection structure for attaching the stopper to a receptacle, a gusset connecting said connection structure to said base, said cover extending radially of the proximal end of said neck at the intersection of the neck and the base.

* * * * *